US009988909B2

(12) United States Patent
Xu

(10) Patent No.: US 9,988,909 B2
(45) **Date of Patent: *Jun. 5, 2018**

(54) HUB FEATURES FOR TURBOCHARGER WHEEL

(75) Inventor: Cheng Xu, Torrance, CA (US)

(73) Assignee: Honeywell International, Inc., Morris Plains, NJ (US)

( * ) Notice: Subject to any disclaimer, the term of this patent is extended or adjusted under 35 U.S.C. 154(b) by 1286 days.

This patent is subject to a terminal disclaimer.

(21) Appl. No.: 13/066,838

(22) Filed: Apr. 25, 2011

(65) Prior Publication Data

US 2012/0269635 A1 Oct. 25, 2012

(51) Int. Cl.
*F01D 5/22* (2006.01)
*F01D 5/14* (2006.01)

(52) U.S. Cl.
CPC ..... *F01D 5/143* (2013.01); *F05D 2220/40* (2013.01)

(58) Field of Classification Search
USPC ..... 416/223 R, 228; 415/914
See application file for complete search history.

(56) References Cited

U.S. PATENT DOCUMENTS 899,319 A 9/1908 Parsons et al.
2,355,413 A 8/1944 Bloomberg
2,918,254 A * 12/1959 Hausammann ..... 415/116
4,465,433 A * 8/1984 Bischoff ..... 416/223 A
5,215,439 A * 6/1993 Jansen et al. ..... 416/183
5,476,363 A 12/1995 Freling et al.
5,730,582 A 3/1998 Heitmann
7,147,433 B2 * 12/2006 Ghizawi ..... 415/164
2008/0152504 A1 * 6/2008 Burton et al. ..... 416/223 R

OTHER PUBLICATIONS

Saha, Arun K., and Acharya, Sumanta "Computation of Turbulent Flow and Heat Transfer Through a Three-Dimensional Nonaxisymmetric Blade Passage," Journal of Turbomachinery, Jul. 2008, pp. 031008-1 to 031008-10, vol. 130, ASME.

Hellstrom, Fredrik, "Numerical Computations of the Unsteady Flow in a Radial Turbine," Thesis, Technical Reports from Royal Institute of Technology, KTH Mechanics, Mar. 2008, Stockholm, Sweden.

* cited by examiner

*Primary Examiner* — Christopher Verdier
*Assistant Examiner* — Kayla McCaffrey
(74) *Attorney, Agent, or Firm* — The Law Office of John A. Griecci

(57) ABSTRACT

A turbocharger including a wheel having suction surfaces and hub surfaces contoured to reduce secondary flow. The suction surfaces are radially contoured with a sinusoidal component, and further have a chamfered edge at the shroud edge. The hub end-walls are contoured both streamwise and cross-stream with sinusoidal components.

8 Claims, 6 Drawing Sheets

HUB FEATURES FOR TURBOCHARGER WHEEL

The present invention relates generally to turbochargers and, more particularly, to a mixed or radial flow turbocharger wheel having contoured surfaces for secondary flow control.

BACKGROUND OF THE INVENTION

Secondary flows are important in understanding the performance of a turbocharger. A primary flow is typically very similar to what would be predicted using the basic principles of fluid dynamics. A secondary flow is typically a flow not in the primary flow. Secondary flows move the fluid in a direction not in primary flow direction which, reduces the fluid energy and increase the losses. Nevertheless, in real world situations there are regions in the flow field where the flow is significantly different in both speed and direction to what is predicted using simple analytical techniques. The flow in these regions is the secondary flow. These regions are usually in the vicinity of the boundary of the fluid adjacent to solid surfaces where viscous forces are at work and near areas that have pressure gradients not in the primary flow direction. For example, a secondary flow could flow in a blade to blade direction for a compressor wheel or a turbine wheel.

Many types of secondary flows occur, including tip clearance flow (e.g., tip leakage), and flows at off-design performance (e.g., flow separation). Such secondary flows cause both an overall loss of flow and a loss of fluid kinetic energy. To improve the efficiency of a turbocharger wheel, e.g., a turbine wheel, secondary flow loss and secondary kinetic energy loss may be minimized. In other words, the wheel may be configured for secondary flow control. For example, the wheel may be manufactured for extra-small tip clearances to limit tip leakage (albeit at additional manufacturing expense).

Turbochargers for vehicular internal combustion engines typically have small turbines. As a result, the blade tip clearances may be relatively significant. Thus, these turbines may be particularly susceptible to secondary flow losses.

Accordingly, there has existed a need for a turbocharger wheel having features characterized in that they provide secondary flow control. Preferred embodiments of the present invention satisfy these and other needs, and provide further related advantages.

SUMMARY OF THE INVENTION

In various embodiments, the present invention solves some or all of the needs mentioned above, typically providing provide secondary flow control for a turbocharger wheel.

The invention provides a turbocharger a wheel having a hub and a plurality of blades of a radial or mixed flow configuration. Each blade has a hub edge adjoining the hub, a shroud edge opposite the hub edge, a leading edge, and a trailing edge. The wheel is configured to rotate around an axis of rotation in a given direction with respect to its leading edge during turbocharger operation such that the leading edge is upstream of the trailing edge, and such that each blade is characterized by a pressurized surface and a suction surface.

The cross-sectional shape of each suction surface, when taken perpendicular to the flow direction at a given streamwise location, is characterized by a blade intermediate portion, a concave inner portion that is closer to the hub edge than the blade intermediate portion, and a concave outer portion that is closer to the shroud edge than the blade intermediate portion. The blade intermediate portion is characterized by a curvature that is both less concave than the inner portion, and less concave than the outer portion.

Between the hub edges of each successive pair of blades, the hub forms a hub end-wall extending between the pressurized surface of a first blade of the successive pair of blades, and the suction surface of a second blade of the successive pair of blades. The blade leading edges, in rotation around the axis of rotation, define an inlet surface. Likewise, the blade trailing edges, in rotation around the axis of rotation, define an outlet surface.

The cross-sectional shape of each hub end-wall, when taken perpendicular to the flow direction at a given streamwise location, is characterized by a cross-stream intermediate portion, a concave first portion that is closer to the first blade than the cross-stream intermediate portion, and a concave second portion that is closer to the second blade than the cross-stream intermediate portion. The cross-stream intermediate portion is characterized by a curvature that is both less concave than the first portion, and less concave than the second portion.

Likewise, the cross-sectional shape of each hub end-wall, when taken parallel to the flow direction at a cross-stream location and represented meridionally, is characterized by a streamwise intermediate portion having a given curvature, a concave upstream portion that is closer to the inlet surface than the streamwise intermediate portion, and a concave downstream portion that is closer to the outlet surface than the streamwise intermediate portion. The streamwise intermediate portion is characterized by a curvature that is both less concave than the upstream portion, and less concave than the downstream portion.

Advantageously, these and other features of the invention, relatively limiting the amount of (and kinetic energy of) secondary flow in the turbine and/or compressor, as compared to a comparable unimproved system.

Other features and advantages of the invention will become apparent from the following detailed description of the preferred embodiments, taken with the accompanying drawings, which illustrate, by way of example, the principles of the invention. The detailed description of particular preferred embodiments, as set out below to enable one to build and use an embodiment of the invention, are not intended to limit the enumerated claims, but rather, they are intended to serve as particular examples of the claimed invention.

DETAILED DESCRIPTION OF THE PREFERRED EMBODIMENTS

The invention summarized above and defined by the enumerated claims may be better understood by referring to the following detailed description, which should be read with the accompanying drawings. This detailed description of particular preferred embodiments of the invention, set out below to enable one to build and use particular implementations of the invention, is not intended to limit the enumerated claims, but rather, it is intended to provide particular examples of them.

Typical embodiments of the present invention reside in a motor vehicle equipped with a gasoline powered internal combustion engine ("ICE") and a turbocharger. The turbocharger is equipped with a unique combination of features that may, in various embodiments, provide efficiency benefits by relatively limiting the amount of (and kinetic energy of) secondary flow in the turbine and/or compressor, as compared to a comparable unimproved system.

Figure 1:
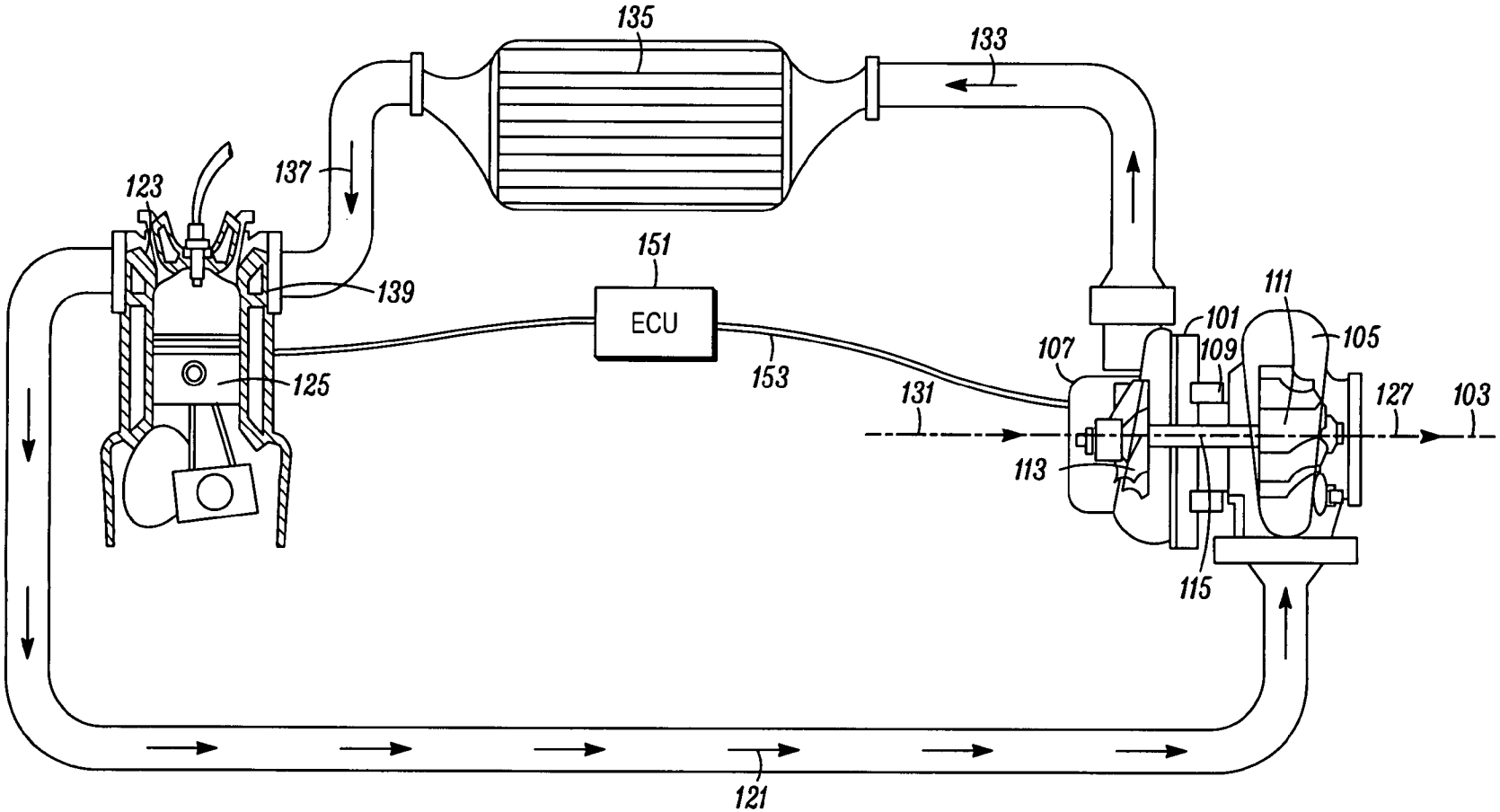
FIG. 1 is a system view of an embodiment of a turbocharged internal combustion engine under the invention.
Figure 2:
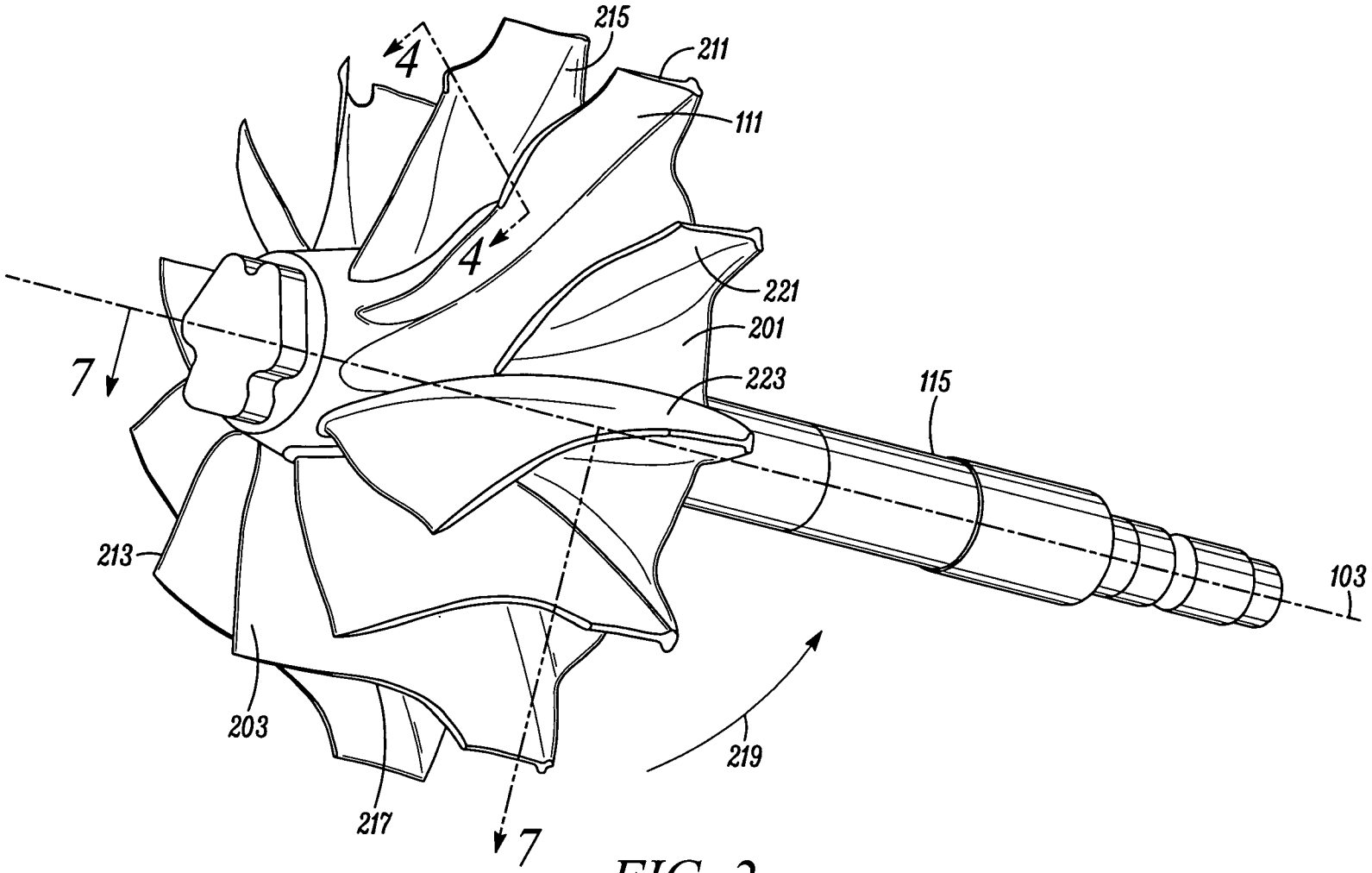
FIG. 2 is a perspective view of a turbine wheel and a shaft, as is provided in the embodiment of FIG. 1.

With reference to FIGS. 1-2, a typical embodiment of a turbocharger 101 having a radial turbine and a radial compressor includes a turbocharger housing and a rotor configured to rotate within the turbocharger housing around an axis of rotor rotation 103 during turbocharger operation on thrust bearings and two sets of journal bearings (one for each respective rotor wheel), or alternatively, other similarly supportive bearings. The turbocharger housing includes a turbine housing 105, a compressor housing 107, and a bearing housing 109 (i.e., a center housing that contains the bearings) that connects the turbine housing to the compressor housing. The rotor includes a radial turbine wheel 111 located substantially within the turbine housing, a radial compressor wheel 113 located substantially within the compressor housing, and a shaft 115 extending along the axis of rotor rotation, through the bearing housing, to connect the turbine wheel to the compressor wheel.

The turbine housing 105 and turbine wheel 111 form a turbine configured to circumferentially receive a high-pressure and high-temperature exhaust gas stream 121 from an engine, e.g., from an exhaust manifold 123 of an internal combustion engine 125. The turbine wheel (and thus the rotor) is driven in rotation around the axis of rotor rotation 103 by the high-pressure and high-temperature exhaust gas stream, which becomes a lower-pressure and lower-temperature exhaust gas stream 127 and is axially released into an exhaust system (not shown).

The compressor housing 107 and compressor wheel 113 form a compressor stage. The compressor wheel, being driven in rotation by the exhaust-gas driven turbine wheel 111, is configured to compress axially received input air (e.g., ambient air 131, or already-pressurized air from a previous-stage in a multi-stage compressor) into a pressurized air stream 133 that is ejected circumferentially from the compressor. Due to the compression process, the pressurized air stream is characterized by an increased temperature over that of the input air.

Optionally, the pressurized air stream may be channeled through a convectively cooled charge air cooler 135 configured to dissipate heat from the pressurized air stream, increasing its density. The resulting cooled and pressurized output air stream 137 is channeled into an intake manifold 139 on the internal combustion engine, or alternatively, into a subsequent-stage, in-series compressor. The operation of the system is controlled by an ECU 151 (engine control unit) that connects to the remainder of the system via communication connections 153.

Figure 3:
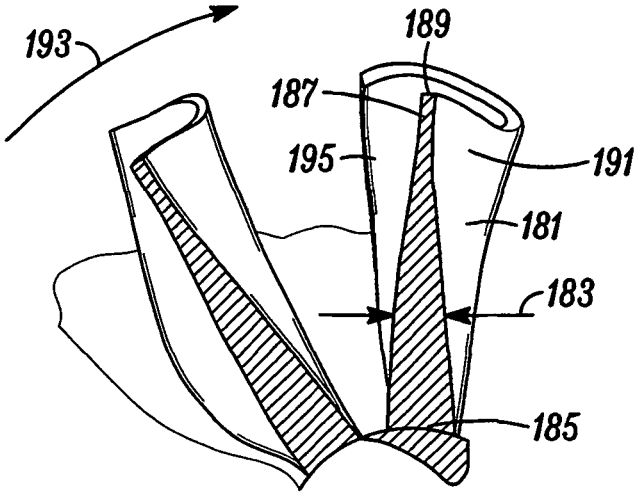
(PRIOR ART) FIG. 3
FIG. 3 is a cross-sectional axial view of a trailing edge of a PRIOR ART turbine blade.

With reference to FIG. 3, a typical turbine blade 181 is known to have a bottle-shaped cross section, wherein the blade thickness 183 smoothly varies from a maximum value at a hub edge 185, down to a minimum thickness at a neck location 187 slightly inward (i.e., toward the hub and directly across the local flow vector at that stream-wise location) of a shroud edge 189, and then back out to a slightly increased thickness at the shroud edge 189. The decreasing thickness between the hub and neck location and the increased thickness near the hub strengthens the blade where it is subject to high forces in some flow conditions. The bottle neck shape cross section of the blade can reduce the blade stress and increase the blade frequency.

As shown in FIG. 3, the typical prior art blade is characterized by a suction surface 191 side that leads the blade with respect to its direction of rotation 193, and a pressurized surface 195 side that trails the blade with respect to its direction of rotation. For both of these surfaces, the curvature of the cross-section is generally flat to convex for most of the distance between the hub edge 185 and the neck portion 187, and very slightly reducing the thickness up to the shroud edge 189.

In the present embodiment, the turbine wheel is characterized by a series of features that adapt the wheel to have superior secondary flow characteristics over the typical turbine wheel. Two of these features are based on the surface shape (i.e., contour) of the blade suction surface. Two other features pertain to the contour of the hub.

Contour of the Suction Side of the Blade

With reference to FIGS. 1, 2, 4 & 5, the wheel 111 includes a hub 201 and a plurality of radial turbine blades 203. Each blade has a leading edge 211 upstream from a trailing edge 213, and a hub edge 215 opposite (i.e., perpendicularly across the local stream from) a shroud edge 217. The wheel is adapted to rotate around the axis of rotation 103 (and more particularly, the blade leading edges 211 are adapted to be driven) in a rotational direction 219 in response to exhaust gas radially received with circumferential kinetic energy, at the leading (i.e., radially outer) edge of the blades, as is typical for radial turbines. The blade leading edges, when driven in rotation around the axis of rotation, define an inlet surface. Likewise, the blade trailing edges, when driven in rotation around the axis of rotation, define an outlet surface.

In response to the exhaust gas, the wheel 111 rotates around the axis of rotation 103 in the rotational direction 219 (with respect to the wheel leading edges) such that each blade 203 is characterized by a pressurized surface 221 and a suction surface 223. The pressurized surface 221 is configured to be driven (i.e., pushed) by a large portion of the high pressure and kinetic energy of the exhaust gas, such that it trails the remainder of blade as the blade moves in the direction of rotation 219. The suction surface 223 leads the blade with respect to its direction of rotation 219, and experiences a significantly lower portion of the pressure and kinetic energy of the exhaust gas.

Figure 4:
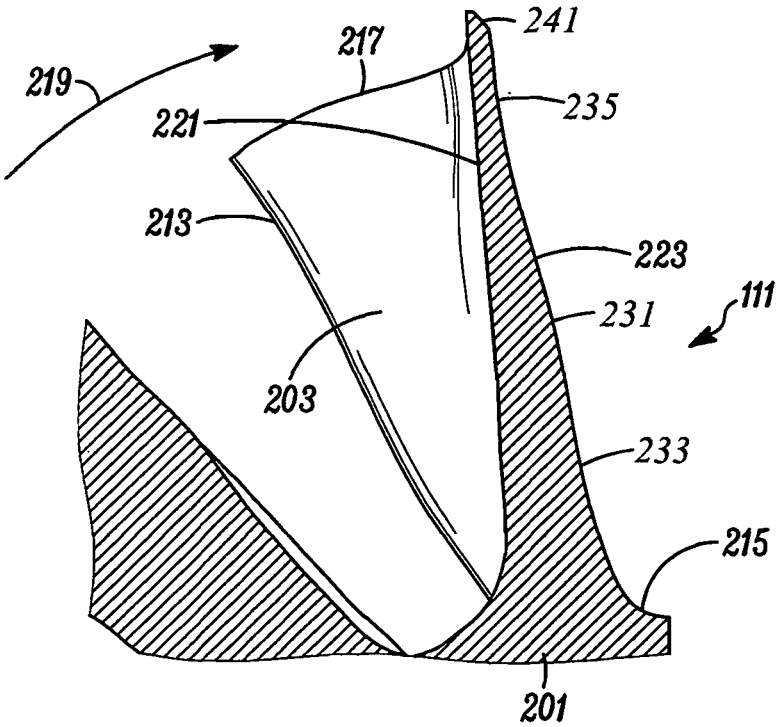
FIG. 4 is a cross-sectional view of a trailing edge of a turbine blade, as provided in FIG. 2, taken in the overall flow direction at that streamwise location and located at section 4-4 of FIG. 2, with certain blade features accentuated for clarity.
Figure 5:
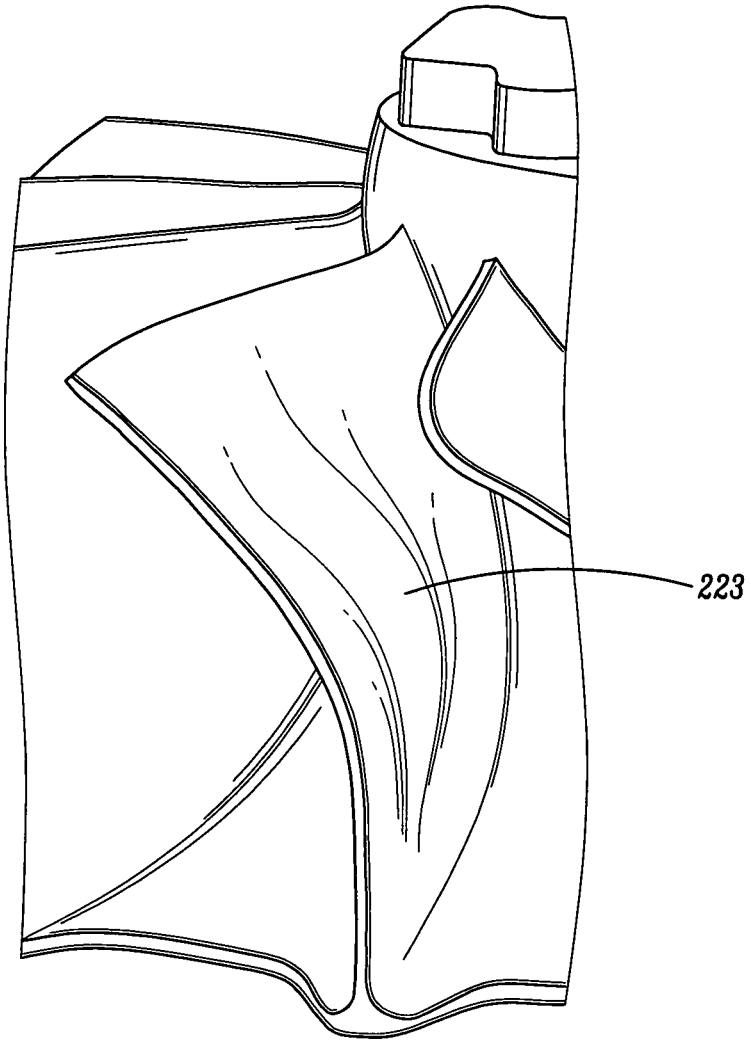
FIG. 5 is a perspective view of a turbine blade, as provided in FIG. 2.

As is seen in FIGS. 4 & 5, which may be disproportionally adjusted to make small features more apparent, the cross-sectional contour of each suction surface 223 from the hub edge 215 to the shroud edge 217, when taken perpendicular to the overall flow direction at that streamwise location with respect to the wheel, is characterized by a blade intermediate portion 231 having a given curvature, a concave inner portion 233 that is closer to the hub edge than the blade intermediate portion, and a concave outer portion 235 that is closer to the shroud edge 217 than the blade intermediate portion. The blade intermediate portion curvature is characterized by a less-concave-curvature than both the inner portion and the outer portion. This feature can be provided across the entire suction surface, or it can be limited to the locations where secondary flow is found to be strong. For example, secondary flow might be found to be strong near the exducer of the turbine blade.

For the purposes of this application, the phrase "a less-concave-curvature" or "a curvature that is less concave," when used to say 'the curvature in section A has a less-concave-curvature than that the curvature in section B,' is defined to require that 1) for a concave section A, B is concave and is characterized by a smaller radius of curvature than section A, 2) for a flat section A, section B is concave, and 3) for a convex section A, section B is concave, flat, or convex with a greater radius of curvature than section A.

More particularly, the cross-sectional shape of each suction surface 223 from the hub edge 215 to the shroud edge 217, when taken perpendicular to the overall flow direction at that streamwise location, is characterized by a smoothly varying shape including (e.g., consisting of) a smoothly varying concave curve with no inflection points added to a cyclical (e.g., sinusoidal) component having at least two inflection points, two of which delineate the borders between the blade intermediate portion 231, the inner portion 233, and the outer portion 235 (i.e., they delineate the border between the blade intermediate portion and the inner portion 233, and they delineate the border between the blade intermediate portion and the outer portion).

In this embodiment, the cyclical component is a sinusoidal variation extending substantially over a period of $2\pi$, running from $-\pi/2$ to $3\pi/2$. The amplitude of this cyclical component is at least 5% of the mean local blade thickness, and typically is between 5% and 20% of the mean local blade thickness. This cross-sectional shape of each suction surface, when taken perpendicular to the overall flow direction at that streamwise location, reduces the local secondary flow and/or the kinetic energy of the secondary flow, and thereby increases the efficiency of the turbine. It may be noted that the smoothly varying concave curvature may still provide for a bottle-neck feature similar to that seen at the neck portion 187 of prior art FIG. 3.

Cropped on the Suction Side of the Blade

The cross-sectional shape of each suction surface 223, taken perpendicular to the overall flow direction at that streamwise location, is further characterized by a cropped (e.g., chamfered) corner 241 at the shroud edge 217 of the suction surface. The cropped corner may form a chamfered surface at an angle between 30° and 60° from the direction that the blade extends in a direction perpendicular to the overall flow direction at that streamwise location. This chamfered corner of each suction surface reduces the local secondary flow and/or the kinetic energy of the secondary flow, and thereby increases the efficiency of the turbine.

For the purposes of this application, a cropped corner on the suction surface is defined as a suction-surface-to-shroud outer edge transition zone characterized by a thickness that is smaller at locations closer to the shroud edge of the blade. In other words, in the region of the shroud outer edge, (e.g., within the blade outer region having a radial thickness that is roughly equal to the blade thickness immediately inward of the cropped corner), the blade thickness tapers down due to the surface shape of the suction surface.

Variations of the cropped corner may include corners that form a round (i.e., a rounded suction surface outer portion that connects the suction surface to the outer shroud edge), a series of partial chamfers (i.e., a series of surfaces) extending the length of the shroud edge and approximating a curved edge, and other configurations that reduce the local secondary flow and/or the kinetic energy of the secondary flow (e.g., a series of steps formed into the outer portion of the suction surface).

The size of the chamfer at the tip is normally between 5% and 100% of the local blade thickness. This chamfer reduces the vortices shedding and reduce the secondary flow losses.

Hub Contour Perpendicular to the Flow

Figure 6:
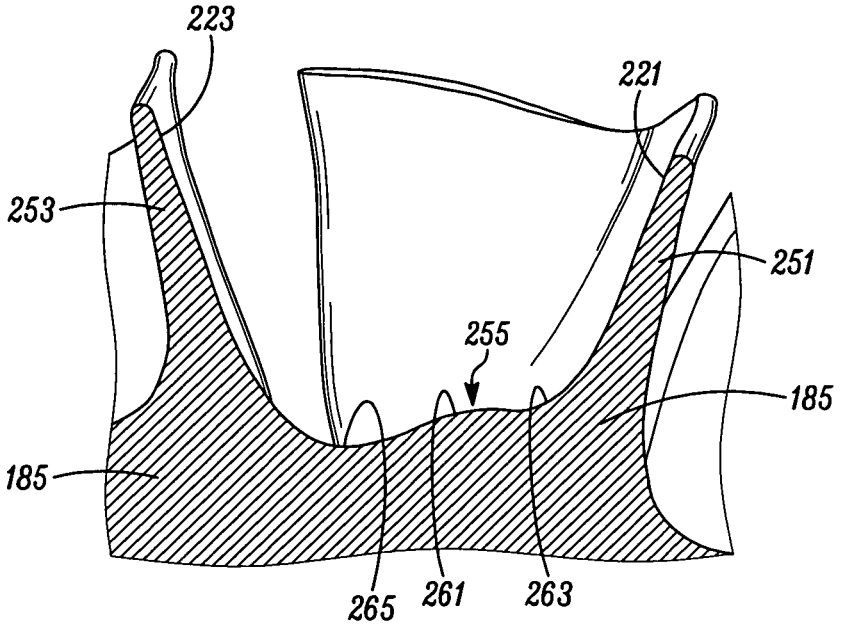
FIG. 6 is another cross-sectional axial view of a trailing edge of a turbine blade, as provided in FIG. 2, taken in the overall flow direction at that streamwise location.

With reference to FIGS. 2 & 6, the wheel hub 201 is characterized by a curvature perpendicular to the flow (i.e., extending between a successive pair of blades) that reduces the local secondary flow and/or the kinetic energy of the secondary flow, and thereby increases the efficiency of the turbine. More particularly, between each hub edge 185 of a successive pair of blades, the hub forms a hub end-wall 255 extending between the pressurized surface 221 of a first blade 251 of the pair of blades and the suction surface 223 of a second blade 253 of the pair of blades. The shape of this end-wall, when viewed in a cross-section taken perpendicular to the overall flow direction at this streamwise location (as shown in FIG. 6), is characterized by a cross-stream intermediate portion 261 having a given curvature, a first portion 263 that is closer to the first blade 251 than the cross-stream intermediate portion, and a second portion 265 that is closer to the second blade 253 than the cross-stream intermediate portion. The cross-stream intermediate portion curvature is characterized by a less-concave-curvature than both the first portion and the second portion.

To that end, the cross-sectional shape of each hub end-wall 255, when taken perpendicular to the overall flow direction at this streamwise location, is characterized by a smoothly varying shape including (e.g., consisting of) a smoothly varying curve with no inflection points added to a cyclical (e.g., sinusoidal) component having at least two inflection points, two of which delineate the borders between the cross-stream intermediate portion 261, the first portion 263, and the second portion 265. In the depicted embodiment, it can be seen that the sinusoidal component results in a hub radius that is larger at its peak value in the cross-stream intermediate portion than the hub radius throughout the first portion. The peak hub radius in the cross-stream intermediate portion is also larger than the minimum hub radius in the second portion.

In this embodiment, the sinusoidal component may be a sine wave extending substantially over a period of $2\pi$ running from $-\pi/2$ to $3\pi/2$, and the amplitude of this cyclical component is at least 5%, and typically between 5% and 20%, of the local blade-to-blade distance at the hub. For a hub curvature perpendicular to the flow, the local blade-to-blade distance at the hub should be understood to be the distance around the hub at the stream-wise position across which the sinusoidal component is extending. In typical variations of this embodiment, the convex cross-stream intermediate portion is closer to the first blade 251 than the second blade 253, and thus, starting at the first blade, the sinusoidal component runs substantially over a period of $2\pi$ starting from a value that is between $-\pi/2$ and 0.

Hub Contour Parallel to the Flow

Figure 7:
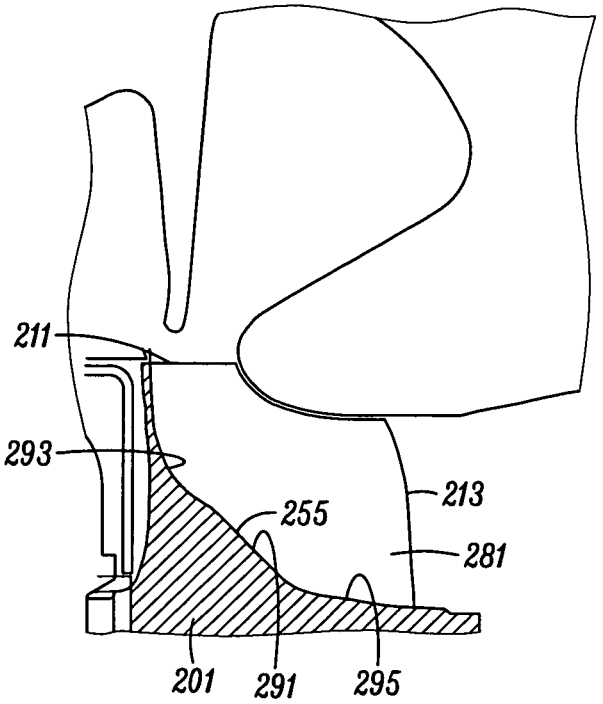
FIG. 7 is a cross-sectional, radial, meridional view of a turbine blade, as provided in FIG. 2, taken along section 7-7 of FIG. 2, with certain hub features accentuated for clarity.

With reference to FIGS. 2 & 7, the wheel hub 201 is characterized by a curvature parallel to the flow that reduces the local secondary flow and/or the kinetic energy of the secondary flow, and thereby increases the efficiency of the turbine. The location of the contour concave portion is commonly opposite to the location of maximum curvature change at the shroud. It should be noted that FIG. 7 is a meridional view, i.e., it depicts a single blade 281 (and the radius of the hub 201 where it adjoins the blade) as being rotationally projected onto the plane of the figure. For the purposes of FIG. 7, the flow of exhaust is effectively in the plane of the figure rather than spiraling through the plane of the figure (as it is in FIG. 2). Thus, the plane of FIG. 7 represents the hub end-wall, depicted meridionally, and viewed with respect to the local flow direction at that cross-stream location.

Between the leading edge 211 and the trailing edge 213 of the blade 281, the hub end-wall 255, when viewed with respect to the local flow direction at a cross-stream location (as represented and shown meridionally in FIG. 7), is characterized by a streamwise intermediate portion 291 having a given curvature, a concave upstream portion 293 that is closer to the inlet surface than the streamwise intermediate portion, and a concave downstream portion 295 that is closer to the outlet surface than the streamwise intermediate portion. The streamwise intermediate portion curvature is characterized by a less-concave-curvature than both the upstream portion and the downstream portion. It should be noted that while the curves may be concave when represented meridionally, their actual configurations are as convex spiraling curves around the axis of rotation. It is the unique aspects that are apparent in the meridional view that are discussed below.

To that end, the cross-sectional shape of the hub end-wall 255, from the leading edge to the trailing edge, represented meridionally and taken parallel to the overall flow direction at that cross-stream location, is characterized by a smoothly varying shape including (e.g., consisting of) a smoothly varying concave curve with no inflection points added to a cyclical (e.g., sinusoidal) component having at least two inflection points, two of which delineate the borders between the less-concave-curvature of the streamwise intermediate portion and the more-concave-curvatures of the upstream portion and the downstream portion.

In this embodiment, the sinusoidal component is generally a sine wave extending substantially over a period of $2\pi$, and the amplitude of the sinusoidal component is at least 2%, and typically between 2% and 8%, of the blade leading edge length. In typical variations of this embodiment, the streamwise intermediate portion may be convex.

In a variation of this embodiment of the invention, the turbocharger turbine wheel may be characterized in that the local height of each blade from the hub edge to the shroud edge, perpendicular to the overall flow direction at that streamwise location, defines a smooth curve that is the sum of a smoothly varying component with no inflection points and a cyclical (e.g., sinusoidal) component having at least two inflection points, two of which delineate the borders between the less-concave-curvature of the streamwise intermediate portion and the more-concave-curvatures of the upstream portion and the downstream portion.

The cyclical component varies over a period of $2\pi$. As may be apparent, this may be accomplished by having a hub curvature that varies to create the recited blade height variation (as described above and shown in FIG. 7), by having a shroud edge curvature that varies to create the recited blade height variation, or by a combination of the two that create the blade height variation. As previously described, the amplitude of the sinusoidal component may optionally be at least 2% of the blade leading edge length and/or at most 8% of the blade leading edge length.

Compressor Wheel Variations

In a variation of the first embodiment of the invention, the turbocharger turbine may be a configured as a mixed flow turbine, that is to say, the exhaust received at the turbine inducer has both radial and axial components.

Figure 8:
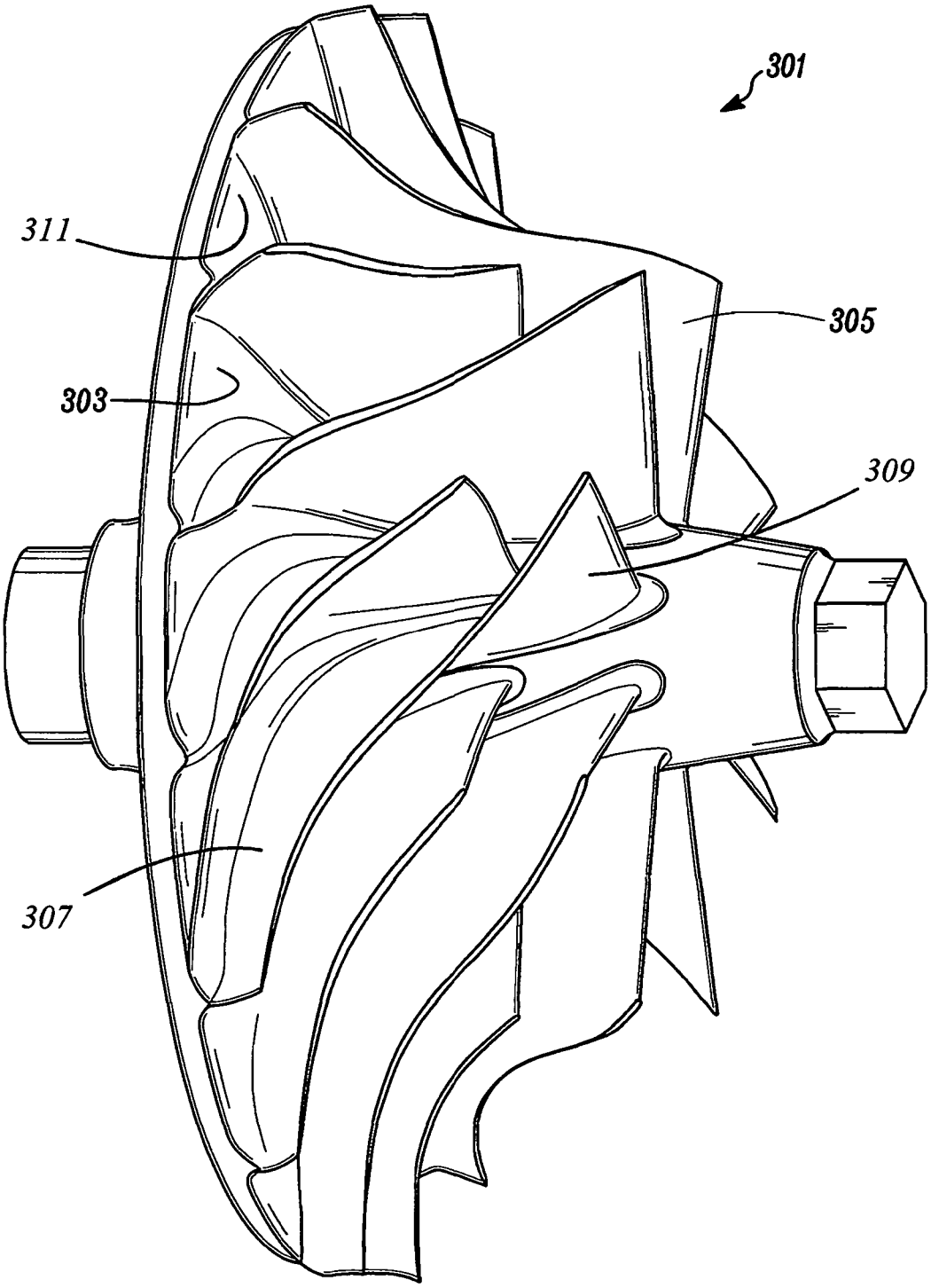
FIG. 8 is a perspective view of a compressor wheel, as is provided in the embodiment of FIG. 1.

With reference to FIG. 8, the embodiment of the invention is further configured with a compressor wheel 301 having a hub 303 and a plurality of blades 305. The blades each have a pressurized surface 307, a suction surface 309, and a hub end-wall 311. While the wheel is shaped with the characteristics of a compressor wheel, the wheel has certain contour enhancements (similar to those of the previously described turbine wheel). More particularly, the compressor wheel includes some or all of the following features:

1) The cross-sectional shape of each blade suction surface 309 from the hub edge to the shroud edge, when taken perpendicular to the overall flow direction at a streamwise location with respect to the wheel, is characterized by a blade intermediate portion having a given curvature, a concave inner portion that is closer to the hub edge than the blade intermediate portion, and a concave outer portion that is closer to the shroud edge than the blade intermediate portion, wherein the blade intermediate portion curvature is characterized by a less-concave-curvature than both the inner portion and the outer portion.

As was described for the turbine wheel, the cross-sectional shape of each suction surface from the hub edge to the shroud edge, when taken perpendicular to the overall flow direction at that streamwise location, is characterized by a smoothly varying shape including (e.g., consisting of) a smoothly varying concave curve with no inflection points added to a cyclical (e.g., sinusoidal) component having at least two inflection points, two of which delineate the borders between the blade intermediate portion, the inner portion, and the outer portion.

In this embodiment, the cyclical component is a sinusoidal variation extending substantially over a period of $2\pi$, running from $-\pi/2$ to $3\pi/2$. The amplitude of the sinusoidal component is at least 5% of the mean local blade thickness, and typically is between 5% and 20% of the mean local blade thickness. This cross-sectional shape of each suction surface, when taken perpendicular to the overall flow direction at that streamwise location, reduces the local secondary flow and/or the kinetic energy of the secondary flow, and thereby increases the efficiency of the turbine.

2) The cross-sectional shape of each suction surface, when taken perpendicular to the overall flow direction at that streamwise location, is further characterized by a cropped (e.g., chamfered) corner at the shroud edge of the suction surface. The cropped corner may form a chamfered surface at an angle between 30° and 60° from the direction that the blade extends in a direction perpendicular to the overall flow direction at that streamwise location. This cropped corner of each suction surface reduces the local secondary flow and/or the kinetic energy of the secondary flow, and thereby increases the efficiency of the turbine.

Variations of the cropped corner may include corners that form a round (i.e., a rounded surface that connects the suction surface to the outer edge of the shroud edge), a series of partial chamfers (i.e., a series of laterally adjoining surfaces) extending the length of the shroud edge and approximating a curved edge, and other configurations that reduce the local secondary flow and/or the kinetic energy of the secondary flow.

3) The cross-sectional shape of each blade hub end-wall, extending between the pressurized surface of a first blade of a successive pair of blades and the suction surface of a second blade of the pair of blades, when viewed in a cross-section taken perpendicular to the overall flow direction at a streamwise location, is characterized by a cross-stream intermediate portion having a given curvature, a first portion that is closer to the first blade than the cross-stream intermediate portion, and a second portion that is closer to the second blade than the cross-stream intermediate portion. The cross-stream intermediate portion curvature is characterized by a less-concave-curvature than both the first portion and the second portion.

To that end, the cross-sectional shape of each hub end-wall, when taken perpendicular to the overall flow direction at this streamwise location, is characterized by a smoothly varying shape including (e.g., consisting of) a smoothly varying curve with no inflection points added to a cyclical (e.g., sinusoidal) component having at least two inflection points, two of which delineate the borders between the cross-stream intermediate portion, the first portion, and the second portion.

In this embodiment, the sinusoidal component is a sine wave extending substantially over a period of $2\pi$ running from $-\pi/2$ to $3\pi/2$, and the amplitude of the sinusoidal component is at least 5%, and typically between 5% and 20%, of the local blade-to-blade distance at the hub. In typical variations of this embodiment, the convex cross-stream intermediate portion is closer to the first blade than the second blade, and thus, starting at the first blade, the sinusoidal component runs substantially over a period of $2\pi$ starting from a value that is between $-\pi/2$ and 0.

4) Between the leading edge and the trailing edge of the blade, the hub end-wall, when viewed with respect to the local flow direction at that cross-stream location (e.g., in a meridional view), is characterized by a streamwise intermediate portion having a given curvature, a concave upstream portion that is closer to an inlet surface defined by the leading edges than the streamwise intermediate portion, and a concave downstream portion that is closer to an outlet surface defined by the trailing edges than the streamwise intermediate portion. The streamwise intermediate portion curvature is characterized by a less-concave-curvature than both the upstream portion and the downstream portion.

To that end, the cross-sectional shape of the hub end-wall, from the leading edge to the trailing edge, viewed meridionally and taken parallel to the overall flow direction at that cross-stream location, is characterized by a smoothly varying shape including (e.g., consisting of) a smoothly varying concave curve with no inflection points added to a cyclical (e.g., sinusoidal) component having at least two inflection points, two of which delineate the borders between the less-concave-curvature of the streamwise intermediate portion and the more-concave-curvatures of the upstream portion and the downstream portion.

In this embodiment, the sinusoidal component is generally a sine wave extending substantially over a period of $2\pi$, and the amplitude of the sinusoidal component is at least 2%, and typically between 2% and 8%, of the blade leading edge length. In some variations of this embodiment, the streamwise intermediate portion is convex.

5) The fifth variation is an alternative version of the fourth variation. In the variation, the turbocharger compressor wheel may be characterized in that the local height of each blade from the hub edge to the shroud edge, perpendicular to the overall flow direction at that cross-stream location, defines a smooth curve that is the sum of a smoothly varying component with no inflection points and a cyclical (e.g., sinusoidal) component having at least two inflection points, two of which delineate the borders between the less-concave-curvature of the streamwise intermediate portion and the more-concave-curvatures of the first portion and the second portion.

The cyclical component varies over a period of $2\pi$. As may be apparent, this may be accomplished by having a hub curvature that varies to create the recited blade height variation (as described above for a turbine with respect to FIG. 7), by having a shroud edge curvature that varies to create the recited blade height variation, or by a combination of the two that create the blade height variation. As previously described, the amplitude of the sinusoidal component may optionally be at least 2% of the local blade height and/or at most 8% of the blade leading edge length.

In a variation of the first embodiment of the invention, the turbocharger compressor may be a configured as a mixed flow compressor, that is to say, the pressurized air exhausted by the compressor exducer (trailing edge) has both radial and axial components.

Other Variations

In variations of the invention, a turbocharger may include only a turbine wheel under the invention, only a compressor wheel under the invention, or both a compressor wheel and a turbine wheel for other applications under the invention. Furthermore, embodiments of the invention can be configured with traditional uniformly distributed blades, or with blades of a non-uniform distribution (such as the blades depicted in FIG. 8, which include both full blades and splitter blades).

It is to be understood that the invention comprises apparatus and methods for designing and producing turbochargers under the invention, as well as for the turbine wheels and compressor wheels for other applications. Additionally, the various embodiments of the invention can incorporate various combinations of the features described above. In short, the above disclosed features can be combined in a wide variety of configurations within the anticipated scope of the invention.

While particular forms of the invention have been illustrated and described, it will be apparent that various modifications can be made without departing from the spirit and scope of the invention. Thus, although the invention has been described in detail with reference only to the preferred embodiments, those having ordinary skill in the art will appreciate that various modifications can be made without departing from the scope of the invention. Accordingly, the invention is not intended to be limited by the above discussion, and is defined with reference to the following claims.

What is claimed is:

1. A turbocharger wheel, comprising:

a hub of a radial or mixed flow configuration, being characterized by an axis of rotation; and a plurality of blades, each blade having a hub edge adjoining the hub, a shroud edge opposite the hub edge, a leading edge, and a trailing edge;

wherein the wheel is configured to rotate around the axis of rotation in a given direction with respect to its leading edge during turbocharger operation such that the leading edge is upstream of the trailing edge, and such that each blade is characterized by a pressurized surface and a suction surface;

wherein the blade leading edges in rotation around the axis of rotation define an inlet surface and the blade trailing edges in rotation around the axis of rotation define an outlet surface;

wherein between the hub edges of each successive pair of blades, the hub forms a hub end-wall extending between the inlet surface and the outlet surface;

wherein the cross-sectional shape of each hub end-wall, when taken parallel to the flow direction at a cross-stream location and represented meridionally, is characterized by a streamwise intermediate portion having a given curvature, a concave upstream portion that is closer to the inlet surface than the streamwise intermediate portion, and a concave downstream portion that is closer to the outlet surface than the streamwise intermediate portion;

wherein the streamwise intermediate portion is characterized by a curvature that is both less concave than the upstream portion, and less concave than the downstream portion;

wherein the cross-sectional shape of each hub end-wall, when taken parallel to the flow direction and represented meridionally, is further characterized at the cross-stream location by a shape defined by a smoothly varying curve that extends across the concave upstream portion, the streamwise intermediate portion and the concave downstream portion, with no inflection points, added to a cyclical component that extends across the concave upstream portion, the streamwise intermediate portion and the concave downstream portion, having at least two inflection points, two of which respectively delineate the border between the upstream portion and the streamwise intermediate portion, and the border between the streamwise intermediate portion and the downstream portion;

wherein between the hub edges of each successive pair of blades, the cross-sectional shape of the hub end-wall, when taken perpendicular to the flow direction at a streamwise location, is characterized by a cross-stream intermediate portion, a first portion that is closer to the first blade than the cross-stream intermediate portion, and a second portion that is closer to the second blade than the cross-stream intermediate portion; and the cross-stream intermediate portion is characterized by a curvature that is both less concave than the first portion, and less concave than the second portion;

wherein the cross-sectional shape of each hub end-wall, when taken perpendicular to the flow direction, is further characterized at the streamwise location by a shape defined by a smoothly varying curve that extends across the first portion, the cross-stream intermediate portion and the second portion, with no inflection points added to a cyclical component that extends across the first portion, the cross-stream intermediate portion and the second portion, having at least two inflection points, two of which respectively delineate the border between the first portion and the cross-stream intermediate portion, and the border between the cross-stream intermediate portion and the second portion; and wherein the height of each blade from the hub edge to the shroud edge, when taken perpendicular to the local flow direction, is characterized by a shape defined by a smoothly varying curve, extending from a leading edge to a trailing edge, with no inflection points, added to a cyclical component, extending from a leading edge to a trailing edge, having at least two inflection points.

2. A turbocharger wheel, comprising:

a hub of a radial or mixed flow configuration, being characterized by an axis of rotation; and a plurality of blades, each blade having a hub edge opposite a shroud edge;

wherein the height of each blade from the hub edge to the shroud edge, when taken perpendicular to the local flow direction, is characterized by a shape defined by a smoothly varying curve from the leading edge to the trailing edge with no inflection points added to a cyclical component from the leading edge to the trailing edge having at least two inflection points.

3. The turbocharger wheel of claim 2, wherein the cyclical component of the shape of the height of each blade from the hub edge to the shroud edge, taken perpendicular to the local flow direction, is a sinusoidal component that varies over a period of $2\pi$.

4. The turbocharger wheel of claim 2, wherein the amplitude of the cyclical component is at least 2% of the blade leading edge length.

5. The turbocharger wheel of claim 4, wherein the amplitude of the cyclical component is at most 8% of the blade leading edge length.

6. The turbocharger wheel of claim 2, wherein the wheel is a turbine wheel.

7. The turbocharger wheel of claim 2, wherein the wheel is a compressor wheel.

8. A turbocharger, comprising the turbocharger wheel of claim 2, and a wheel housing configured to receive the turbocharger wheel.

* * * * *